US006123085A

United States Patent [19]

Johnson

[11] Patent Number: 6,123,085

[45] Date of Patent: Sep. 26, 2000

[54] HAIR TWIST

[76] Inventor: Kathleen Roberta Johnson, 19523 White Saddle Dr., Germantown, Md. 20874

[21] Appl. No.: 09/491,434

[22] Filed: Jan. 26, 2000

[51] Int. Cl.[7] ..... A45D 8/36

[52] U.S. Cl. ..... 132/246; 132/275

[58] Field of Search ..... 132/246, 222, 132/275

[56] References Cited

U.S. PATENT DOCUMENTS

| | | | |
|---|---|---|---|
| 348,263 | 8/1886 | Blakesley | 132/246 |
| 2,161,478 | 6/1939 | Locke | 132/246 |
| 2,649,097 | 8/1953 | Chernack | 132/246 |
| 4,892,110 | 1/1990 | Harvie | 132/222 |
| 4,911,186 | 3/1990 | Hayden | 132/246 |
| 5,303,723 | 4/1994 | Schach | 132/246 |
| 5,890,494 | 4/1999 | Sonstegard | 132/246 |

*Primary Examiner*—Todd E. Manahan
*Attorney, Agent, or Firm*—Patrick J. Walsh

[57] ABSTRACT

A hair twist as a flexible retainer for selecting a degree of tension for holding hair selecting a gentle and loose hold, or a tight hold. The hair twist comprises a composite of sheets of fabric, sponge towel, and carpet padding with a wire core all rolled into a cylinder. The cylinder is placed straight under a pony tail gathered at the back of the head, and the cylinder is twisted in place about the pony tail.

3 Claims, 3 Drawing Sheets

HAIR TWIST

BACKGROUND OF THE INVENTION

The present invention relates to personal grooming and particularly to a device for gathering and holding hair at the back of the head.

There are hair retaining products on the market fabricated of metal, plastic, elastic, and rubber which hold hair to a single or fixed degree of tension. Such retainers do not hold for long and tend to slide out of place after they are put in the hair. In addition, they tend to tangle painfully in the hair.

This invention solves these problems by providing a new and improved flexible hair twist that provides variable degrees of tension for holding hair at the back of one's head.

SUMMARY OF THE INVENTION

The present invention provides a hair twist that provides a new way to hold hair for hours without the need for readjustment after being put in place. A hair twist according to the invention comprises a flexible retainer which allows individuals to choose the degree of tension for holding hair selecting a gentle and loose hold, or a tight hold. The hair twist holds the chosen degree of tension for hours without the need for readjustment.

In a preferred embodiment, the hair twist comprises a composite of sheets of fabric, sponge towel, and carpet padding with a wire core all rolled into a cylinder. The elongate cylinder is placed straight under a pony tail gathered at the back of the head, and the cylinder is twisted in place about the pony tail.

The hair twist is an easy, fun and great looking way for any person to hold their hair back from their face. It is light, flexible and feels comfortable to hold onto. This is a beneficial product for all people that are ready for a new and innovative way to fasten and decorate the hair.

OBJECTS OF THE INVENTION

An object of the invention is to provide a hair twist for holding a pony tail in place for hours at substantially the same degree of tension.

Another object of the invention is to provide a hair twist fabricated of flexible materials that holds a pony tail which a selected degree of tension.

Another object of the invention is to provide a hair twist the remains in place for hours without the need for readjustment.

Another object is to provide a hair twist enabling a person to hold hair back from the face using any degree of tension that is comfortable.

Another object is to provide an innovative way to fasten and decorate the hair.

Other and further objects of the invention will become apparent with an understanding of the following detailed description of the invention or upon employment of the invention in practice.

A preferred embodiment of the invention has been chosen for purposes of detailed description and is shown in the accompanying drawing in which:

FIG. 1 is an exploded perspective view of the components of a preferred embodiment of the hair twist in position for assembly.

FIGS. 2 and 2*a* are schematic views illustrating assembly sequence of the hair twist components.

FIG. 3 is a perspective view of a hair twist according to the invention.

FIGS. 4*a*–4*d* illustrate the steps for using a hair twist.

DETAILED DESCRIPTION OF THE PREFERRED EMBODIMENT

Figure 1:
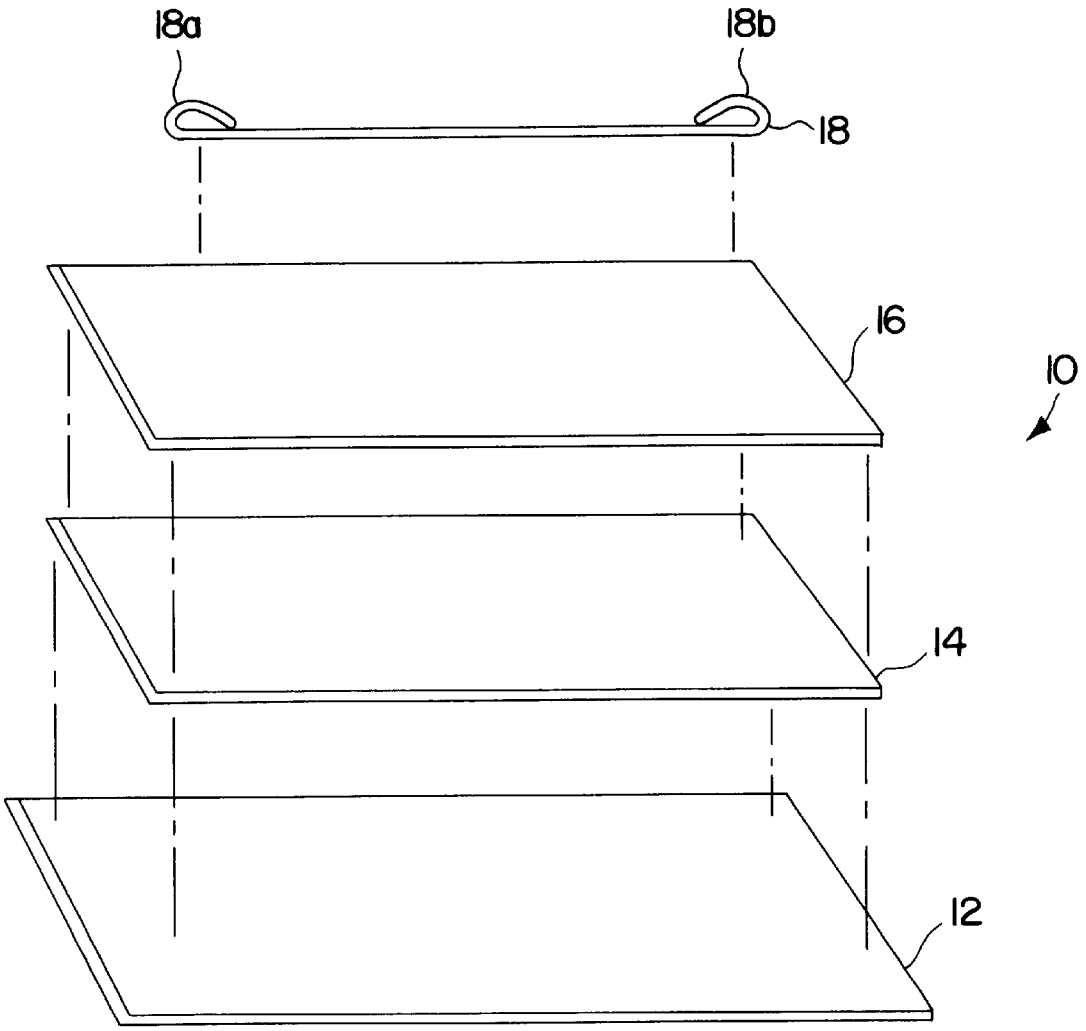

Referring to the drawing, a preferred embodiment of the hair twist 10 is shown in FIG. 1 with components placed in order for assembly. The components include a sheet of decorative fabric 12, a fluffy or cushioning sheet 14 such as a sheet of sponge towel, a gripping sheet 16 such as a piece of carpet padding for holding a wire core in place, and wire core 18 for retaining hair twist shape when twisted in place.

The decorative fabric 12 is a piece of colored or colored and patterned fabric cut 11½ inches long by 3½ inches wide.

The fluffy or cushioning sheet 14 is preferably a piece of sponge towel approximately 1/16 inch thick measuring 9 inches long by 2½ inches wide. This component cushions the hair twist so it feels comfortable to the touch.

The gripping sheet 16 serves to keep the wire core from slipping around inside the hair twist. Sheet 16 is perferably a piece of carpet padding measuring 9 inches long by 2 inches wide.

The wire core 18 is 16 guage steel wire measuring 9½ inches long with ends 18*a*, 18*b* turned inward for smooth, safe ends.

Figure 2:
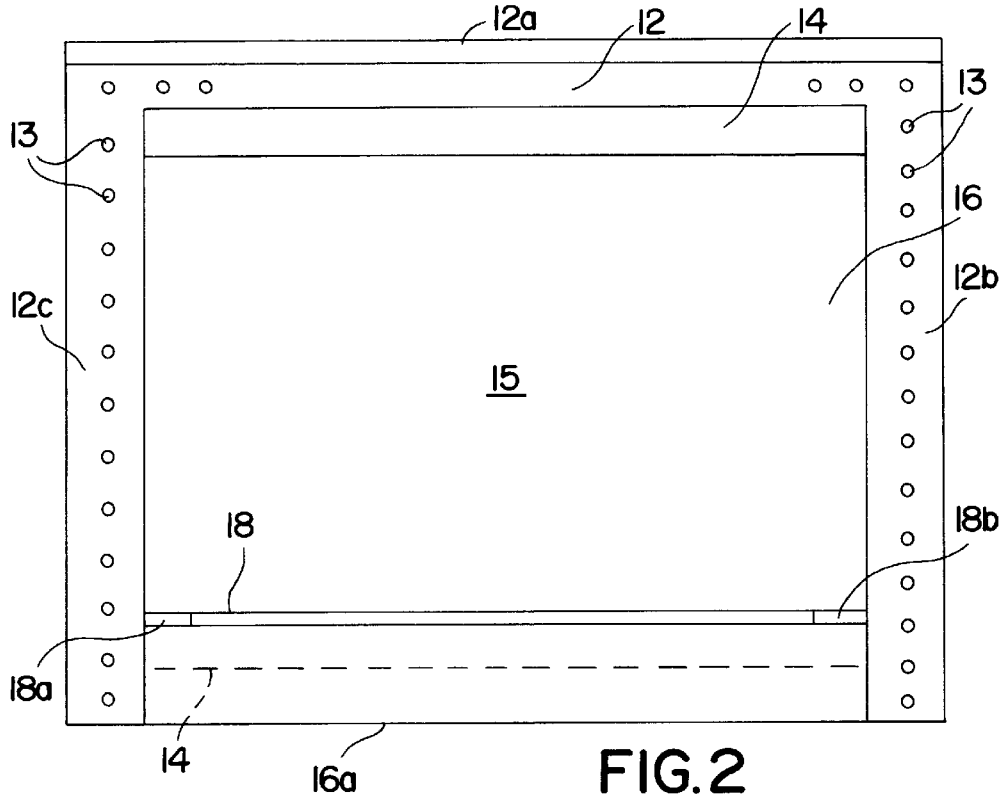
Figure 2A:
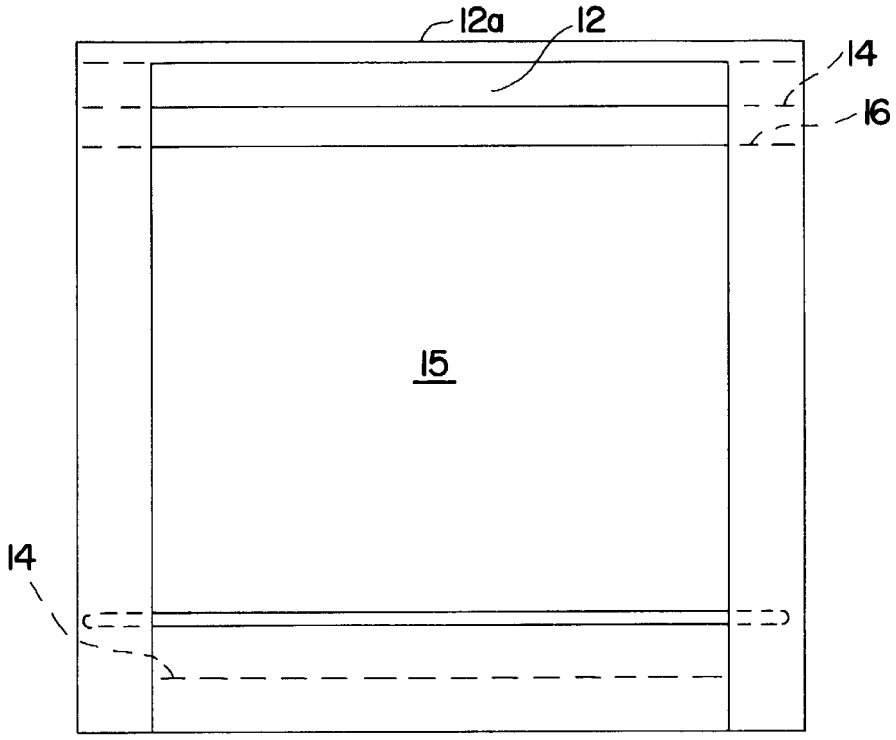
Figure 3:
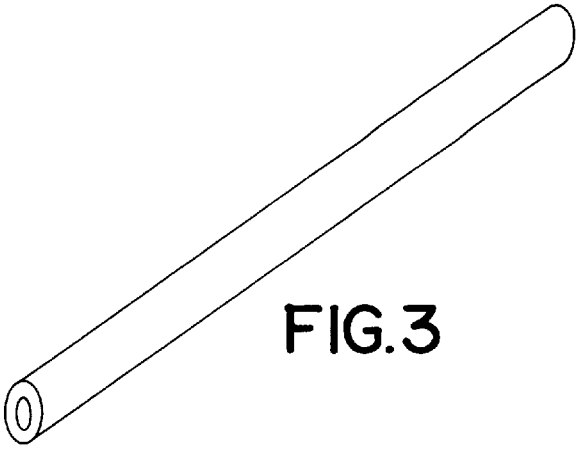
Figure 4A:
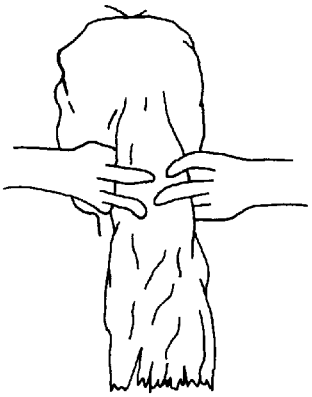
Figure 4B:
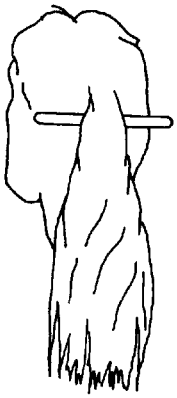
Figure 4C:
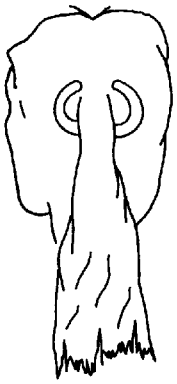
Figure 4D:
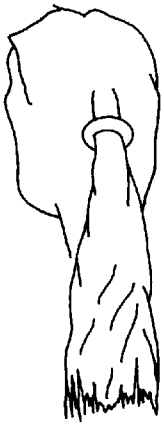

The steps for assembling the components are illustrated schematically in FIGS. 2 and 2*a* and include:

- fold, iron and glue down a one-eighth inch edge 12*a* from the topmost portion of the fabric 12 to provide a smooth edge or seam on the finished hair twist;
- center the cushioning sheet 14 on the fabric;
- glue the carpet padding at the bottom most edge 16*a* (approximately 1/16 to 1/8 inches from the bottom most edge) onto of the fabric and sponge towel;
- place and glue the wire core onto the carpet padding approximately ¼ inch up from the bottom edge 16*a;*
- apply glue 13 to the exposed right and left edges 12*b*, 12*c* of the fabric and fold and secure the edges in place over the carpet fabric and wire core ends; and
- apply glue to the central face 15 of the work piece and starting at the bottom edge, roll into a cylinder as in FIG. 3.

In use as shown in FIGS. 4*a*–4*d*, the elongate cylinder is placed straight under a pony tail gathered at the back of the head, and the cylinder is twisted in place about the pony tail.

The foregoing presents a preferred embodiment of the invention and modifications can be made within the scope thereof. For example, the fabric 12 may include decorative paint, stickers, beads and other decorative material. Facing, starch, orother fabric stiffener may be used to help the hair twist to kee its shape. The sponge towel may be replaced by any suitable material for giving the hair twist a cushioned or fluffy touch. The sponge towel may be omitted in making a thinner hair twist. The carpet padding may be replaced by any suitable material the keeps the wire core from slipping within the hair twist.

Various changes may be made to the structure embodying the principles of the invention. The foregoing embodiments are set forth in an illustrative and not in a limiting sense. The scope of the invention is defined by the claims appended hereto.

I claim:

1. A hair twist comprising a composite of sheets of decorative fabric, sponge towel, and carpet padding with a wire core all rolled into a cylinder, the elongate cylinder being adapted to be placed straight under a pony tail gathered at the back of the head, with the cylinder twisted in place about the pony tail.

2. A hair twist comprising an outer decorative fabric, an inner cushioning layer, an inner gripping layer, and a wire core, the fabric, cushioniong layer and gripping layer rolled into a cylinder with the wire core at the center of the cylinder, the cylinder being adapted for placement straight under a pony tail gathered at the back of the head and twisted in place about the pony tail.

3. A method for fabricating a hair twist from a fabric sheet, a cushioning sheet, a gripping sheet, and a wire core comprising these steps:

a. fold, iron and glue down an edge of the topmost portion of the fabric sheet to provide a smooth edge or seam on the finished hair twist;

b. center the cushioning sheet on the fabric leaving exposed right and left margins of the fabric;

c. glue the gripping sheet at the bottom most edge onto of the fabric and cushioning sheet;

d. place and glue the wire core onto the gripping sheet near the bottom edge thereof;

e. apply glue to the exposed right and left edges of the fabric and fold and secure the edges in place over the carpet fabric and wire core ends; and f. apply glue to the central face of the work piece and starting at the bottom edge, roll into a cylinder.

* * * * *